US006745917B2

(12) United States Patent
Koyama et al.

(10) Patent No.: US 6,745,917 B2
(45) Date of Patent: Jun. 8, 2004

(54) SHEET PACKAGE

(75) Inventors: Yasuhiro Koyama, Kagawa (JP); Takeshi Bando, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 103 days.

(21) Appl. No.: 10/138,353

(22) Filed: May 3, 2002

(65) Prior Publication Data

US 2002/0166868 A1 Nov. 14, 2002

(30) Foreign Application Priority Data

May 10, 2001 (JP) ..... 2001-139714

(51) Int. Cl.[7] ..... B65G 9/00
(52) U.S. Cl. ..... 221/48; 221/49
(58) Field of Search ..... 221/48, 49

(56) References Cited

U.S. PATENT DOCUMENTS

| | | | | |
|---|---|---|---|---|
| 3,581,935 A | * | 6/1971 | Chi | 221/1 |
| 4,718,152 A | | 1/1988 | Suzuki et al. | 28/104 |
| 5,301,401 A | | 4/1994 | Suzuki et al. | 28/167 |
| 5,632,072 A | | 5/1997 | Simon et al. | 26/69 R |
| 5,761,778 A | | 6/1998 | Fleissner | 28/104 |
| 5,960,525 A | | 10/1999 | Fleissner | 28/104 |

FOREIGN PATENT DOCUMENTS

| | | | |
|---|---|---|---|
| EP | 0926288 | 6/1999 | D04H/1/46 |
| EP | 0972873 | 1/2000 | D04H/1/46 |
| EP | 1138474 | 10/2001 | B32B/5/26 |
| JP | 10-174663 | 6/1998 | A47K/7/00 |
| WO | 93/20272 | 10/1993 | D04H/1/44 |
| WO | 97/42366 | 11/1997 | D04H/1/46 |
| WO | 99/19551 | 4/1999 | D04H/1/54 |
| WO | 01/711081 | 9/2001 | D04H/13/00 |

* cited by examiner

*Primary Examiner*—Donald P. Walsh
*Assistant Examiner*—Kaitlin Joerger
(74) *Attorney, Agent, or Firm*—Darby & Darby

(57) ABSTRACT

Disclosed is a sheet package including: a sheet stack formed by folding and stacking rectangular sheets; and a container having a dispensing opening through which the sheets are to be removed. Each sheet is first folded on an X-axis folding line substantially parallel to one side of the rectangular shape, and then folded on a Y-axis folding line substantially perpendicular to the X-axis folding line, thereby to form a folded sheet having two outermost sheet portions appearing on two external surfaces thereof and intermediate sheet portions positioned between the outermost sheet portions. Adjacent folded sheets are combined such that X-axis folding lines of the adjacent folded sheets are positioned at opposite sides of the sheet stack and only an outermost sheet portion of one folded sheet is sandwiched between an outermost sheet portion and an intermediate sheet portion of the other folded sheet.

4 Claims, 9 Drawing Sheets

SHEET PACKAGE

BACKGROUND OF THE INVENTION

1. Field of the Invention

The present invention relates to sheet package comprising: a sheet stack formed by folding and stacking a plurality of sheets; and a container accommodating the sheet stack, the container having a dispensing opening through which the sheets are to be sequentially removed.

2. Description of the Related Art

Sheets for wiping hands, infant's buttocks and the like and for cleaning toilet, kitchen and the like are typically accommodated in a soft or hard container (receptacle) so that they may be removed (taken out) one at a time through a dispensing opening formed in the container. Especially when impregnated with a liquid, they are effective in wiping off stains.

Among sheet packages of this kind, a so-called pop-up type of sheet package is formed such that individual sheets are folded while being combined with each other, and the sheets thus folded are stacked and accommodated in the container.

FIG. 9A shows one example of combined structure of folded sheets in a conventional pop-up type of sheet package, wherein each sheet S, which is of rectangular shape in a developed state, is folded on one folding line 61 in a V configuration, thereby forming a folded sheet having sheet portions S1 and S2. In this case, adjacent folded sheets are combined such that a sheet portion S1 of one folded sheet is sandwiched between sheet portions S1 and S2 of the other folded sheet.

In an alternative, as shown in FIG. 9B, each sheet S is folded on two folding lines 62 and 63 in a Z configuration, thereby forming a folded sheet having sheet portions S3, S4 and S5. Then, a sheet portion S3 of one of the adjacent folded sheets is sandwiched between sheet portions S4 and S5 of the overlying folded sheet.

In an invention disclosed in Japanese Unexamined Patent Publication (Kokai) No. 10-174663 (174663/1998), on the other hand, each sheet S is first folded on one folding line 64 in two, and then, further folded on two folding lines 65 and 66 perpendicular to the folding line 64 in a Z configuration, as shown in FIG. 9C. This folded sheet has two-ply sheet portions S6, S7 and S8. Between adjacent folded sheets, the two-ply sheet portion S6 of one folded sheet is sandwiched between the two-ply sheet portions S7 and S8 of the overlying folded sheet.

In such pop-up type of sheet package, when the sheet confronting the dispensing opening is removed through the dispensing opening, a portion of the next sheet is pulled by the preceding sheet to protrude from the dispensing opening. In the prior art shown in FIG. 9A, for example, the sheet portion S1 of the next folded sheet protrudes from the dispensing opening. In the prior art shown in FIG. 9B, the sheet portion S3 of the next folded sheet protrudes from the dispensing opening. In the prior art shown in FIG. 9C, the two-ply sheet portion S6 of the next folded sheet protrudes from the dispensing opening.

Especially when the sheets are impregnated with a liquid to be wet sheets, the preceding sheet and the next sheet are adhered through a liquid membrane. Therefore, the sheet portion S1, S3 or S6 of the next sheet can be certainly pulled by the preceding sheet to protrude from the dispensing opening. Then, the next sheet is given resistance from the dispensing opening to be separated from the removed sheet. Thus, the next sheet remains accommodated in the container, except for the sheet portion protruding from the dispensing opening. With the sheet portion of the next sheet protruding from the dispensing opening, the next sheet can be easily removed from the container by pinching the protruding sheet portion.

However, in case where the sheet S is folded in a V configuration, as shown in FIG. 9A, the area of the folded sheet is as large as about ½ the area of the sheet S in the developed state. In case where the sheet S is folded in a Z configuration, as shown in FIG. 9B, the area of the folded sheet is as large as about ⅓ the area of the sheet S in the developed state. Accordingly, when the folded sheets are stacked and accommodated in the container, the sheet package becomes relatively voluminous, causing inconvenience in carrying about.

On the other hand, in the prior art shown in FIG. 9C, the area of the folded sheet is as small as about ⅙ the area of the sheet S in the developed state, thereby making the sheet package compact and easy to carry about. However, in this sheet stack, the two-ply sheet portion S6 of one folded sheet is sandwiched between the two-ply sheet portions S7 and S8 of the overlying folded sheet. When the preceding sheet is removed through the dispensing opening, therefore, the sheet portion S6 of the next sheet protrudes from the dispensing opening while remaining in two-ply state. Accordingly, when removed through the dispensing opening by pinching the two-ply sheet portion 6, the sheet S can not be completely unfolded, but remains folded in two on the folding line 64. Since the sheet S remains folded in two even after removal, the area available for wiping operation becomes small, causing inconvenience in handling. If the user wants to perform wiping operation with a larger area, it is required to unfold the sheet S (thus removed in two-ply state) by hands. This is also inconvenient.

SUMMARY OF THE INVENTION

The present invention has been worked out in view of the shortcoming in the prior art set forth above. It is therefore an object of the present invention to provide a sheet package, in which sheets are compactly accommodated in a container and can be unfolded in the course of removal through a dispensing opening of the container.

According to the present invention, there is provided a sheet package comprising: a sheet stack formed by folding and stacking a plurality of rectangular sheets; and a container accommodating the sheet stack, the container having a dispensing opening through which the sheets are to be removed, each sheet being first folded on at least one X-axis folding line substantially parallel to one side of the rectangular shape, and then folded on at least one Y-axis folding line substantially perpendicular to the X-axis folding line, thereby to form a folded sheet having two outermost sheet portions appearing on two external surfaces thereof and intermediate sheet portions positioned between the outermost sheet portions, adjacent folded sheets being combined such that X-axis folding lines of the adjacent folded sheets are positioned at opposite sides of the sheet stack and only an outermost sheet portion of one folded sheet is sandwiched between an outermost sheet portion and an intermediate sheet portion of the other folded sheet.

In the present invention, since the individual sheets are folded on the X-axis folding line and the Y-axis folding line, the resulting folded sheet has a relatively small area. Therefore, both the sheet stack and the container for accommodating it can be made compact. Moreover, in the course of removal through the dispensing opening, the individual sheets can be unfolded and developed to have a large area. This eliminates the need of unfolding and developing the sheets after they have been removed. Therefore, the removed sheets can be used for wiping operation as it is.

In one embodiment, each sheet may be first folded on a single X-axis folding line and then folded on two Y-axis folding lines. In this case, the single X-axis folding line makes the folding structure of the folded sheet quite simple, and the two Y-axis folding lines make the area of the folded sheet quite small.

The sheets may be impregnated with a liquid so that between the adjacent folded sheets, the outermost sheet portions are separably adhered to each other through the liquid. In this case, the adhesion through the liquid can ensure the protrusion of the outermost sheet portion of the next sheet at the time of removal of the preceding sheet, even though the sheets are compactly folded on the X-axis and Y-axis folding lines.

In the present invention, when a sheet is removed through the dispensing opening, an outermost sheet portion of another sheet adjacent to the sheet being removed can be dragged to protrude from the dispensing opening.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
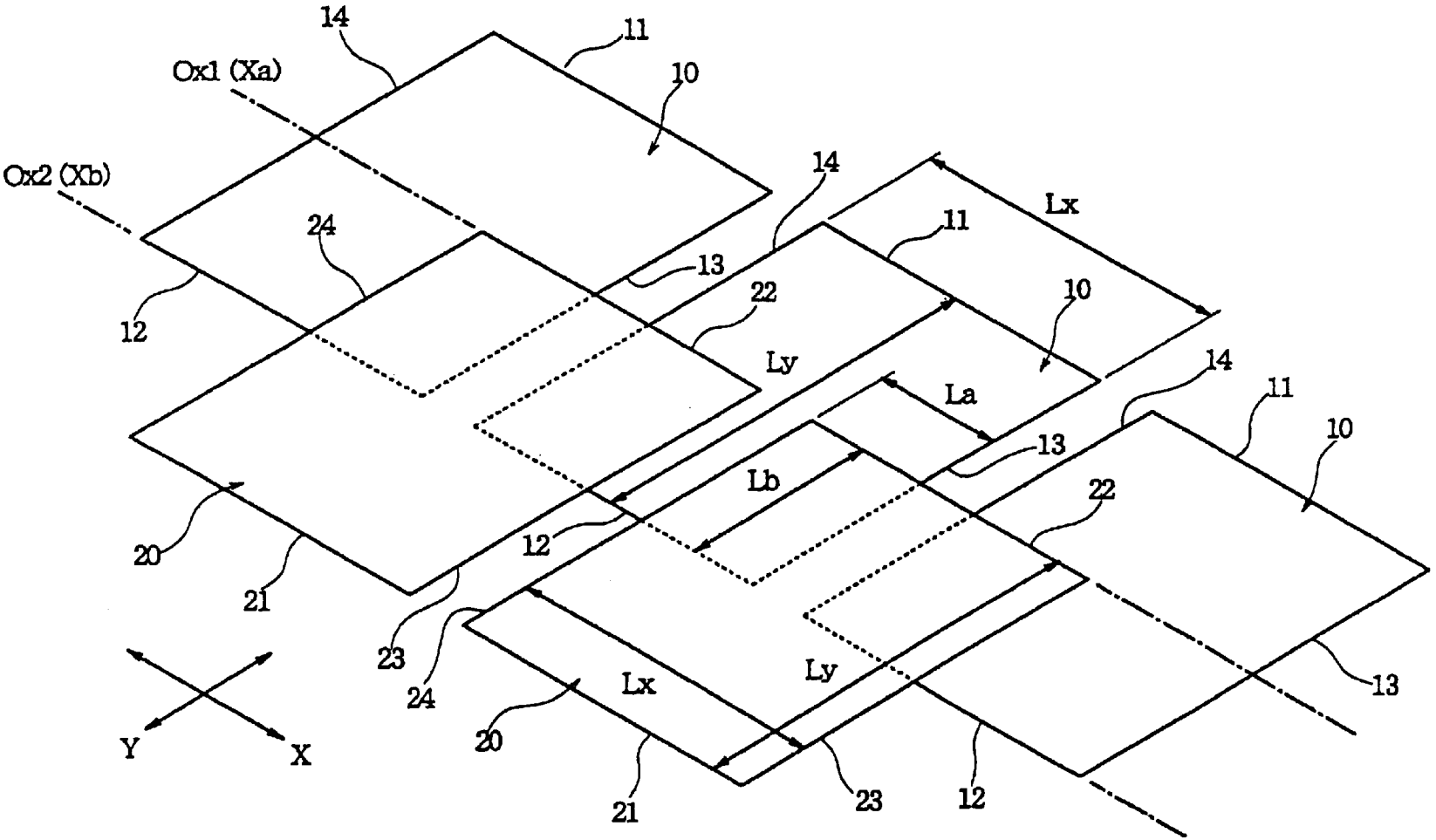
FIG. 1 is a perspective view illustrating the state where first and second sheets are combined in a developed state.
Figure 2:
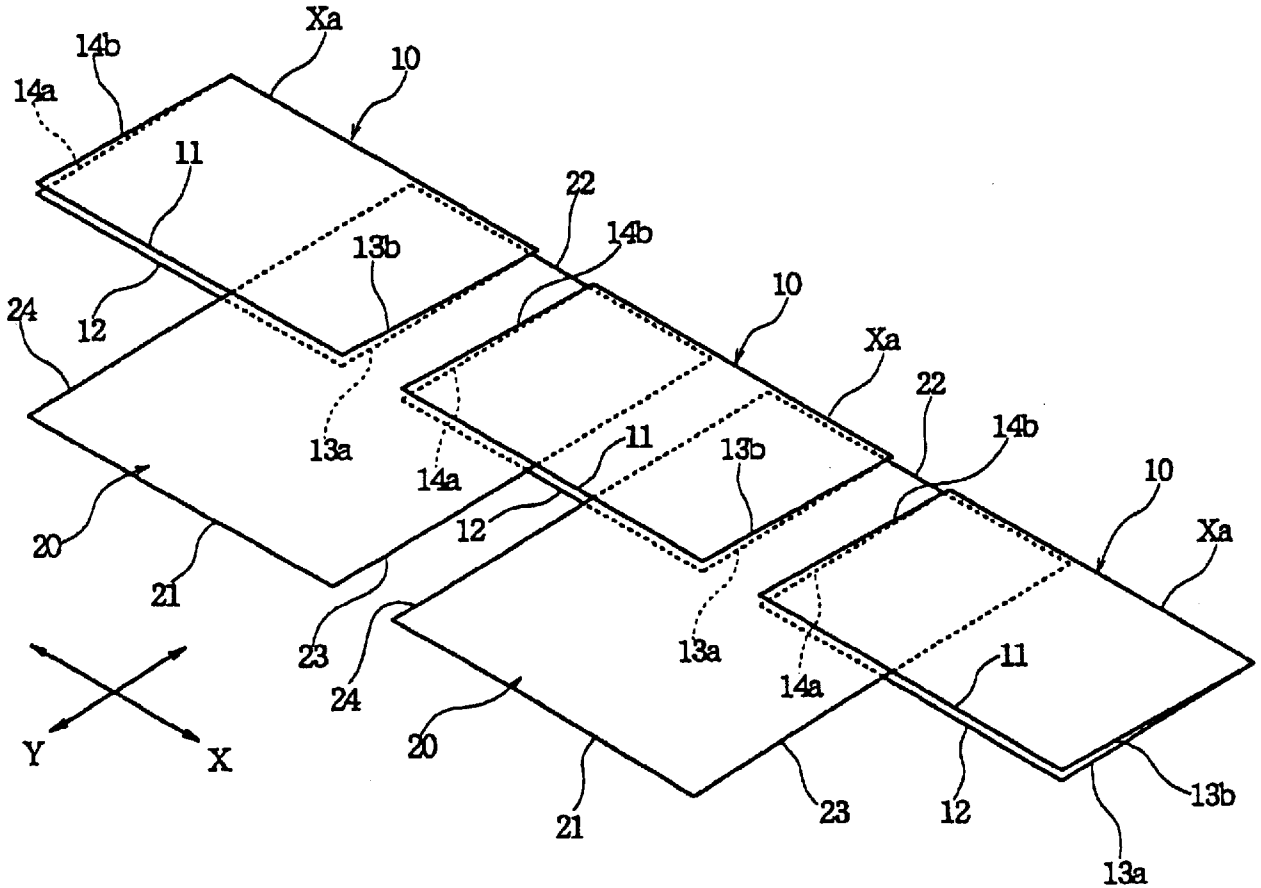
FIG. 2 is a perspective view illustrating the state where the first sheets are folded after the step of FIG. 1.
Figure 3:
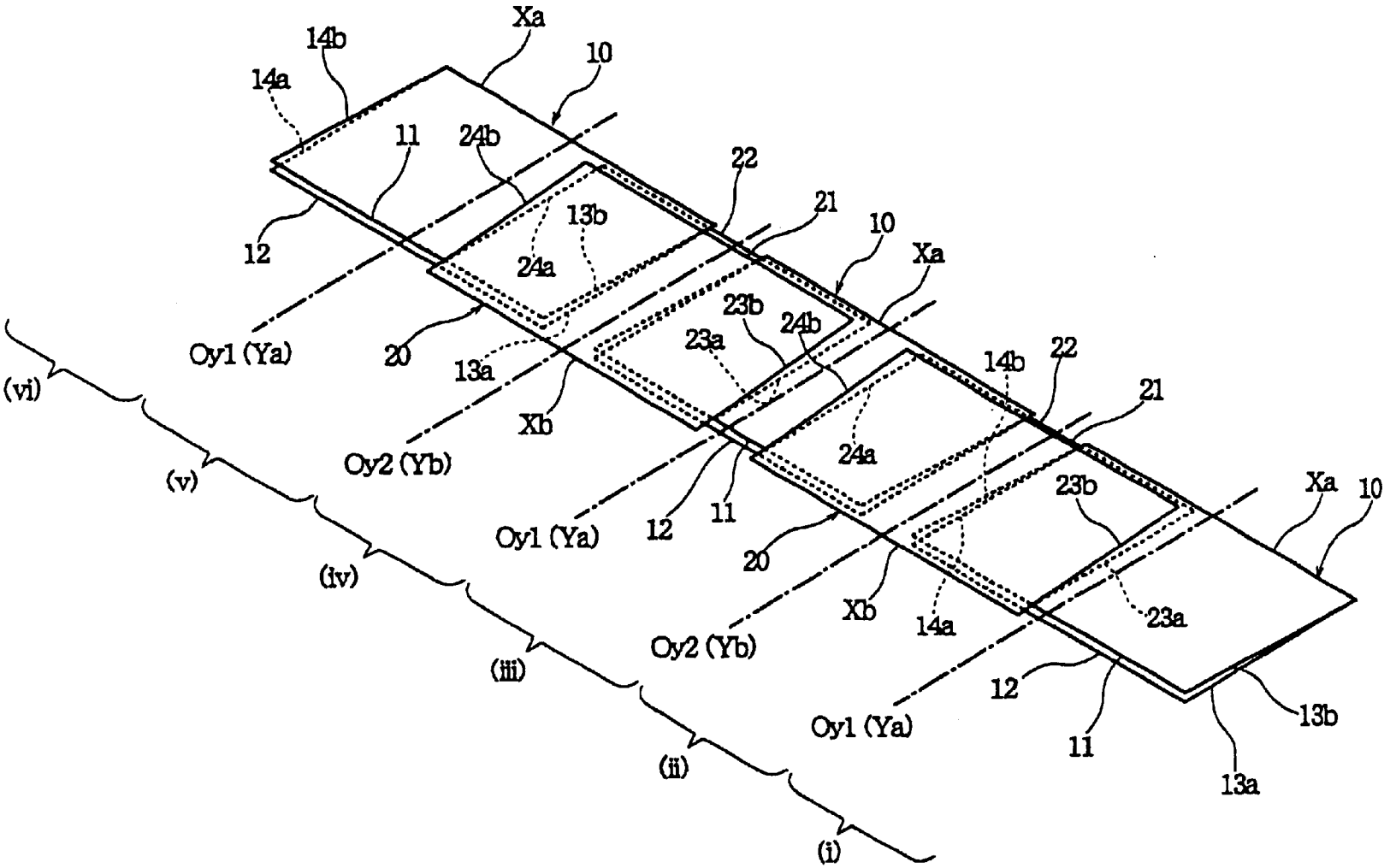
FIG. 3 is a perspective view illustrating the state where the second sheets are folded after the step of FIG. 2.
Figure 4:
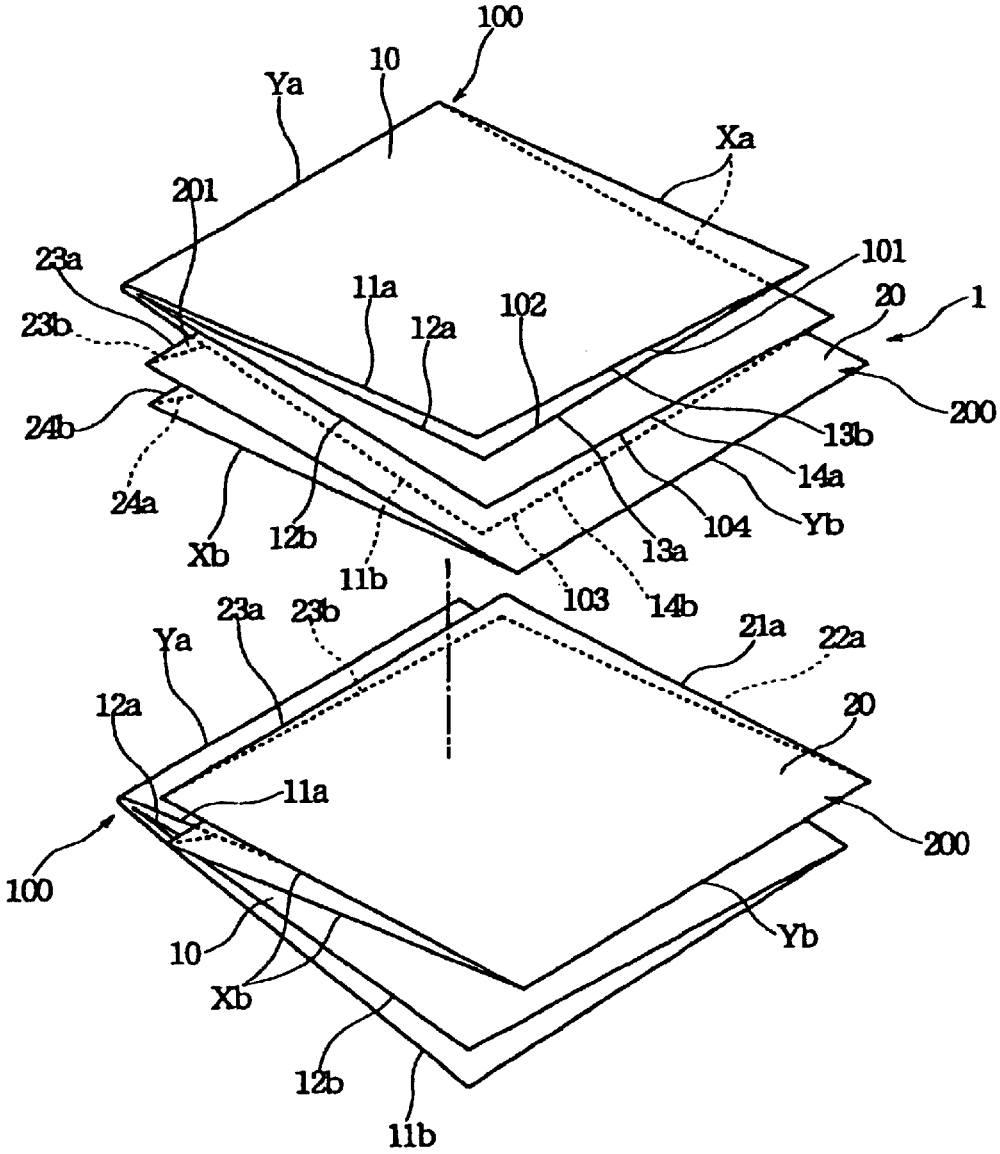
FIG. 4 is a perspective view illustrating a sheet stack according to a first embodiment of the present invention.
Figure 5:
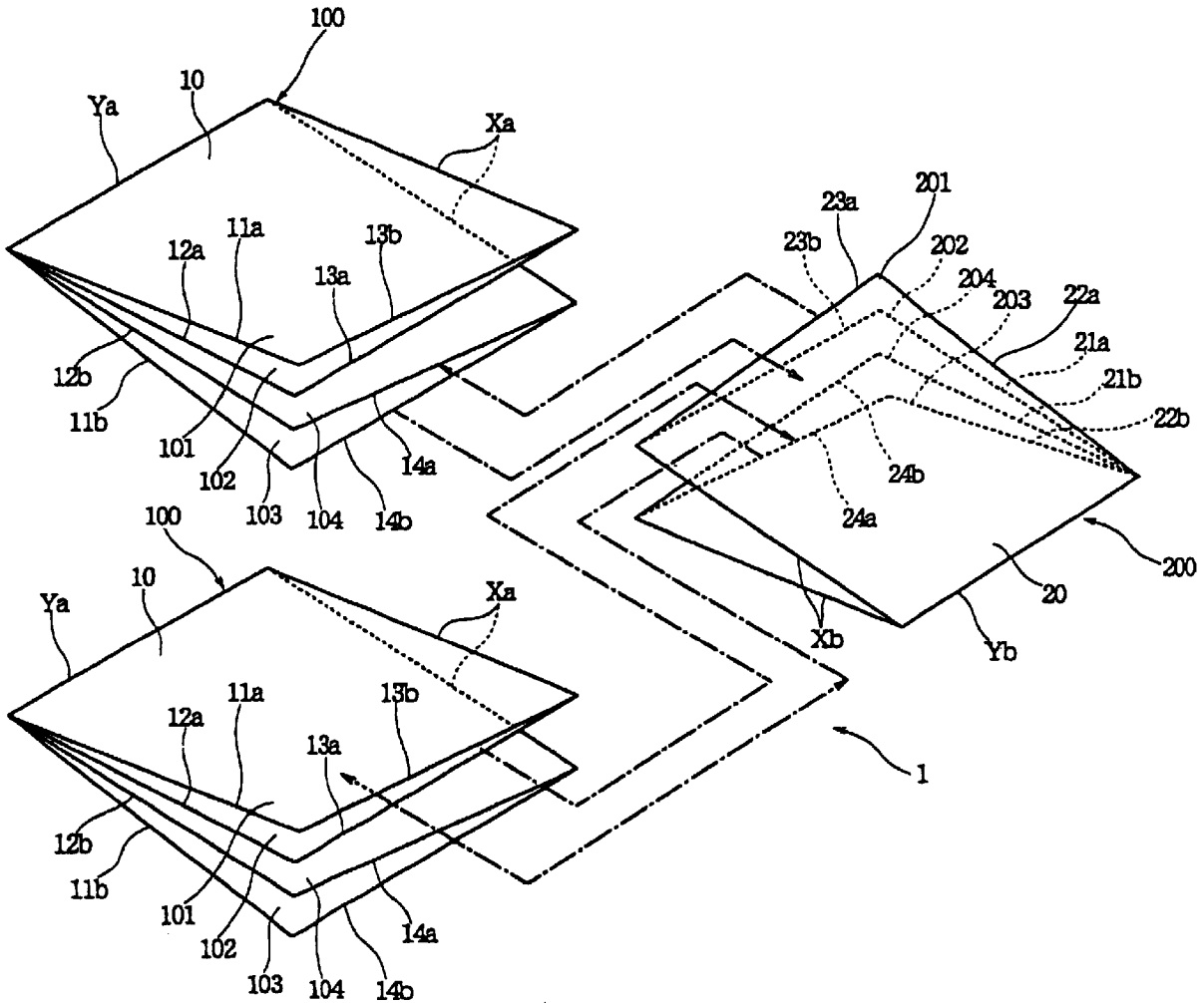
FIG. 5 is a perspective view illustrating how sheets are combined in the sheet stack of the first embodiment, with first folded sheets and second folded sheets being separated from each other.
Figure 6:
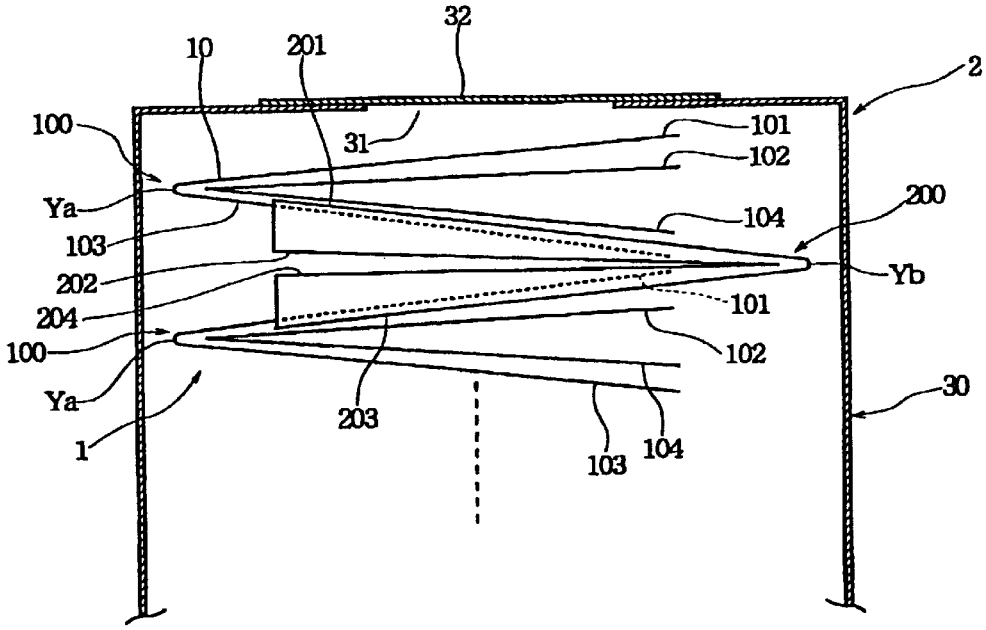
FIG. 6 is a sectional view illustrating the state where the sheet stack of the first embodiment is accommodated in a container.
Figure 7:
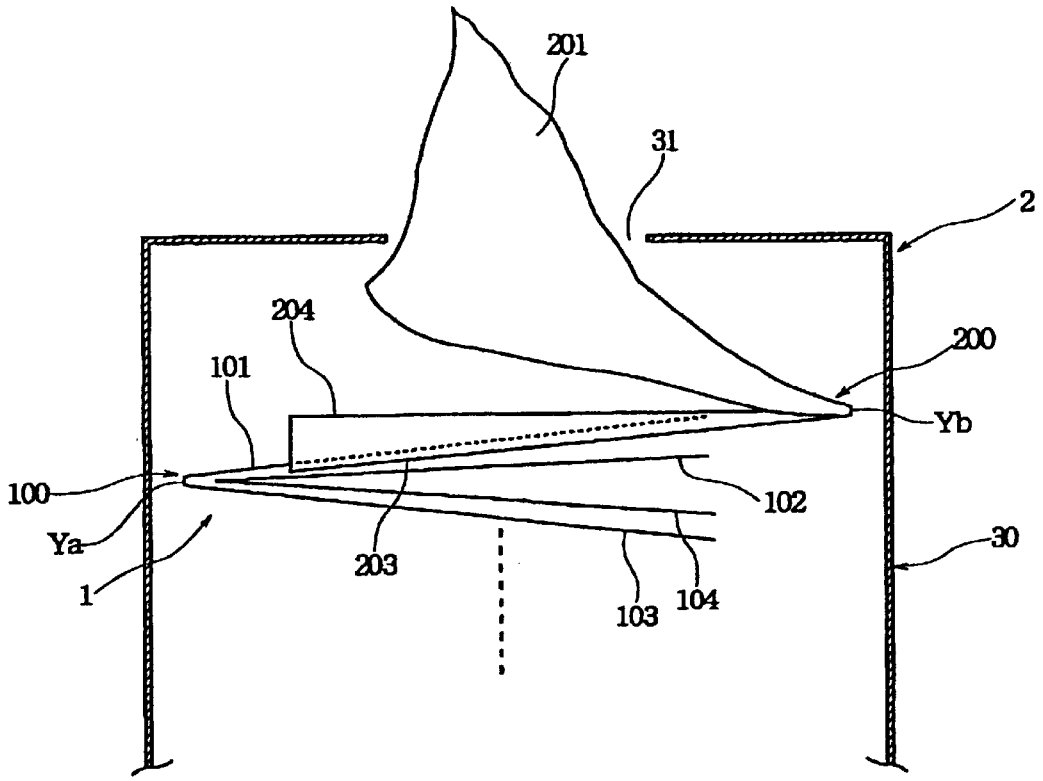
FIG. 7 is a sectional view illustrating the state where a portion of a sheet protrudes from a dispensing opening of the container.

FIGS. 1, 2 and 3 are perspective views successively illustrating a process for forming folded sheets of a sheet package according to a first embodiment of the present invention; FIG. 4 is a perspective view illustrating a sheet stack; FIG. 5 is an explanatory view illustrating how first and second sheets are combined in the sheet stack; FIG. 6 is a sectional view illustrating the state where the sheet stack is accommodated in a container; and FIG. 7 is a sectional view illustrating the state where a portion of a sheet protrudes from a dispensing opening of the container.

FIGS. 4 and 5 show a sheet stack 1, in which first folded sheet 100 and second folded sheet 200 are alternately combined and stacked. Here, the first folded sheets 100 are formed by folding first sheets 10; the second folded sheets 200 are formed by folding second sheets 20.

FIG. 1 shows the first sheets 10 and the second sheets 20 in a developed state, respectively. In the developed state before folding, the first sheet 10 is of a quadrangular (rectangular) shape, of which: the length of short sides 11 and 12 extending along X-axis direction is indicated at Lx; and the length of the long sides 13 and 14 extending along Y-axis direction is indicated at Ly. In the developed state before folding, the second sheet 20 is also of a quadrangular (rectangular) shape, of which: the length of short sides 21 and 22 extending along X-axis direction is indicated at Lx; and the length of the long sides 23 and 24 extending along Y-axis direction is indicated at Ly. In the shown embodiment, the first sheet 10 and the second sheet 20 are identical in size and thickness. Also, the first sheet 10 and the second sheet 20 are made of the same material.

In the shown embodiment, the rectangular sheet having a size of Lx×Ly in the developed state is embodied in the first sheet 10 and the second sheet 20 having a single-ply structure. However, in the present invention, the sheet before folding on the X-axis and Y-axis direction should not be limited to such single-ply structure, but may also have a multi-ply structure by stacking a plurality of rectangular sheets, folding a sheet of a larger area in two or more, or the like.

The first sheet 10 and the second sheet 20 comprise: natural fibers such as pulp; regenerated cellulose fibers such as rayon; synthetic fibers of polyethylene, polypropylene, polyester, or the like; bicomponent synthetic fibers of polyethylene and polypropylene, polyethylene and polyester, or the like; or combinations thereof. For the first sheet 10 and the second sheet 20, these fibers are first formed into a web, followed by water-jet treatment to form spunlaced nonwoven fabric. In an alternative, these fibers may be formed into another kind of nonwoven fabric using different process. In another alternative, the first and second sheets 10 and 20 may be paper formed from the natural fibers and/or the regenerated cellulose fibers.

The nonwoven fabric or paper for the first and second sheets 10 and 20 may be water-disintegratable. The term "water-disintegratable" as used here means that when a large amount of water is given, constituent fibers of nonwoven fabric or paper are dispersed so that the nonwoven fabric or paper can be disintegrated. Water-disintegratable nonwoven fabric or paper may be formed such that fibers are interconnected in a disintegratable structure, and a water-soluble or water swellable binder such as carboxymethyl cellulose (CMC), polyvinyl alcohol (PVA) or the like, is added thereto. Here, it is also possible to form water-disintegratable nonwoven fabric without such water-soluble or water swellable binder, by employing short rayon fibers or the like and entangling fibers with water jets. This water-disintegratable nonwoven fabric can be disintegrated in water such that when a large amount of water is added, the short cellulose fibers and the like are disentangled. In this case, the fiber length of the cellulose fibers is preferably at most 10 mm, more preferably at most 7 mm. In an alternative, water-disintegratable nonwoven fabric or paper may contain fibrillated rayon which can function as a binder, in addition to ordinary rayon fibers, pulp and the like.

For forming the sheet stack 1 of FIG. 4, as shown in FIG. 1, the first sheets 10 and the second sheets 20 are first arranged in X-axis direction, respectively, so that the long sides 13 and 14 of the first sheets 10 and the long sides 23 and 24 of the second sheets 20 are in substantially parallel relationship. At this time, each second sheet 20 overlaps with two first sheets 10 and 10 on two sides thereof so that the overlapping area between the second sheet 20 and one first sheet 10 is equal to that between the second sheet 20 and the other first sheet 10. In each overlapping region between the first sheet 10 and the second sheet 20, the length in the X-axis direction is indicated at La; and the length in the Y-axis direction is indicated at Lb. The area of La×Lb is about or less than ¼ the area of Lx×Ly (which is the area of the first sheet 10 and the second sheet 20 in the developed state).

With the length Lb being set ½ the length Ly, the short side 22 of the second sheet 20 coincides with the centerline OX1 of the first sheet 10 which extends on the midpoints of the long sides 13 and 14; and the short side 12 of the first sheet 10 coincides with the centerline OX2 of the second sheet 20 which extends on the midpoints of the long sides 23 and 24. In such condition, moreover, if adjacent first sheets 10 and 10 approach to eliminate the spacing between the long side 13 of one first sheet 10 and the long side 14 of the other first sheet 10 and adjacent second sheets 20 and 20 also approach to eliminate the spacing between the long side 23 of one second sheet 20 and the long side 24 of the other second sheet 20, the length La becomes ½ the length Lx, resulting in that the area La×Lb of the overlapping region is ¼ the area Lx×Ly of the developed sheet.

For example, in case where the length Ly of the long side is set to be 200 mm and the length Lx of the short side is set to be 150 mm in both sheets 10 and 20, it is preferred that the length Lb of the overlapping region is from 80 to 100 mm (80 to 100% of Ly/2) and the length La of the overlapping region is from 60 to 75 mm (80 to 100% of Lx/2).

After the first sheets 10 and the second sheets 20 are arranged as in FIG. 1, the individual first sheets 10 are folded in two on an X-axis folding line Xa coinciding with the centerline OX1, as shown in FIG. 2, so that the short side 11 substantially coincides with the short side 12 in each first sheet 10, reducing its area to about one half of the area in the developed state. At this time, edges 13*a* and 13*b*, which are two halves of the long side 13 of the first sheet 10, are in overlying relationship with each other through the second sheet 20; and edges 14*a* and 14*b*, which are two halves of the long side 14 of the first sheet 10, are likewise in overlying relationship with each other through the second sheet 20.

Next, as shown in FIG. 3, the individual second sheets 20 are folded on an X-axis folding line Xb coinciding with the centerline OX2, so that the short side 21 substantially coincides with the short side 22 in each second sheet 20, reducing its area to about one half of the area in the developed state. At this time, edges 23*a* and 23*b*, which are two halves of the long side 23 of the second sheet 20, are in overlying relationship with each other through a portion of the first sheet 10; and edges 24*a* and 24*b*, which are two halves of the long side 24 of the second sheet 20, are likewise in overlying relationship with each other through a portion of the first sheet 10.

In FIG. 3, the centerline of the first sheet 10 which extends on the midpoints of the short sides 11 and 12 is indicated at Oy1; and the centerline of the second sheet 20 which extends on the midpoints of the short sides 21 and 22 is indicated at Oy2. In FIG. 3, moreover, the region between the centerline Oy1 and the edges 13*a* and 13*b* of the rightmost first sheet 10 is indicated at (i); the regions between the centerlines Oy1 and Oy2 are indicated at (ii), (iii), (iv) and (v) from the right to the left; and the region between the centerline Oy1 and the edges 14*a* and 14*b* of the leftmost first sheet 10 is indicated at (vi).

From the condition shown in FIG. 3, the region (i) is folded back against the region (ii) on a first Y-axis folding line Ya extending along the centerline Oy1 so that the region (ii) is located beneath the region (i). Then, the region (ii) is folded back against the region (iii) on a second Y-axis folding line Yb extending along the centerline Oy2 so that the region (iii) is located beneath the region (ii). Moreover, the region (iii) is folded back against the region (iv) on the first Y-axis folding line Ya so that the region (iv) is located beneath the region (iii). The band of interconnected sheets of FIG. 3 is concertina-folded by repeating such operation sequentially, so that the first folded sheets 100 (first sheet 10 folded to have four-ply structure) and the second folded sheets 200 (second sheet 20 folded to have four-ply structure) are alternately stacked to form the sheet stack 1 shown in FIG. 4.

In FIG. 5, the first and second folded sheets 100 and 200 are illustrated in a separated condition for explaining how the first and second folded sheets 100 and 200 are combined in the sheet stack 1 shown in FIG. 4.

For forming the first folded sheet 100, the first sheet 10 is folded on the first Y-axis folding line Ya which extends on the midpoints of the long sides 11 and 12, as shown in FIG. 5. Therefore, in the first folded sheet 100, the long side 11 is divided in two to provide edges 11*a* and 11*b*, and the long side 12 is divided in two to provide edges 12*a* and 12*b*.

On the upper surface of the first folded sheet 100, an outermost sheet portion 101 appears. This outermost sheet portion 101 is a rectangular sheet portion defined by a portion (first half) of the X-axis folding line Xa, the first Y-axis folding line Ya, and the edges 11*a* and 13*b* which are both in free state. That is, the four sides of the rectangular outermost sheet portion 101 are defined by the first half of the X-axis folding line Xa, the first Y-axis folding line Ya, and the free edges 11*a* and 13*b*. Likewise, on the lower surface of the first folded sheet 100, another outermost sheet portion 103 appears. This outermost sheet portion 103 on the lower surface is a rectangular sheet portion defined by a portion (second half) of the X-axis folding line Xa, the first Y-axis folding line Ya, and the edges 11*b* and 14*b* which are both in free state.

Inside of the outermost sheet portion 101 appearing on the upper surface of the first folded sheet 100, an intermediate sheet portion 102 is located. This intermediate sheet portion 102 is a rectangular sheet portion defined by a portion (first half) of the X-axis folding line Xa, the first Y-axis folding line Ya, and the edges 12*a* and 13*a* which are both in free state. Inside of the outermost sheet portion 103 appearing on the lower surface of the first folded sheet 100, another intermediate sheet portion 104 is located. This intermediate sheet portion 104 is a rectangular sheet portion defined by a portion (second half) of the X-axis folding line Xa, the first Y-axis folding line Ya, and the edges 12*b* and 14*a* which are both in free state.

Similarly, on the upper surface of the second folded sheet 200, an outermost sheet portion 201 appears. This outermost sheet portion 201 is a rectangular sheet portion defined by a portion (first half) of the X-axis folding line Xb, the second Y-axis folding line Yb, and the edges 22*a* and 23*a* which are both in free state. On the lower surface of the second folded sheet 200, another outermost sheet portion 203 appears. This outermost sheet portion 203 is a rectangular sheet portion defined by a portion (second half) of the X-axis folding line Xb, the second Y-axis folding line Yb, and the edges 22*b* and 24*a* which are both in free state.

Inside of the outermost sheet portion 201 appearing on the upper surface of the second folded sheet 200, an intermediate sheet portion 202 is located. This intermediate sheet portion 202 is a rectangular sheet portion defined by a portion (first half) of the X-axis folding line Xb, the second Y-axis folding line Yb, and the edges 21*a* and 23*b* which are both in free state. Inside of the outermost sheet portion 203 appearing on the lower surface of the second folded sheet 200, another intermediate sheet portion 204 is located. This intermediate sheet portion 204 is a rectangular sheet portion defined by a portion (second half) of the X-axis folding line Xb, the second Y-axis folding line Yb, and the edges 21*b* and 24*b* which are both in free state.

In the sheet stack 1, as shown in FIGS. 4 and 5, the X-axis folding lines Xa of the first folded sheets 100 and the X-axis folding lines Xb of the second folded sheets 200 are positioned at opposite sides, and the first Y-axis folding lines Ya of the first folded sheets 100 and the second Y-axis folding lines Yb of the second folded sheets 200 are also positioned at opposite sides.

In FIG. 5, the second folded sheet 200 and the first folded sheet 100 overlying it are combined such that the outermost sheet portion 201 appearing on the upper surface of the second folded sheet 200 is sandwiched between the outermost sheet portion 103 appearing on the lower surface of the first folded sheet 100 and the intermediate sheet portion 104 overlying it. That is, the outermost sheet portion 103 appearing on the lower surface of the first folded sheet 100 is sandwiched between the outermost sheet portion 201 appearing on the upper surface of the second folded sheet 200 and the intermediate sheet portion 202 underlying it.

On the other hand, the second folded sheet 200 and the first folded sheet 100 underlying it are combined such that the outermost sheet portion 203 appearing on the lower surface of the second folded sheet 200 is sandwiched between the outermost sheet portion 101 appearing on the upper surface of the first folded sheet 100 and the intermediate sheet portion 102 underlying it. That is, the outermost sheet portion 101 appearing on the upper surface of the first folded sheet 100 is sandwiched between the outermost sheet portion 203 appearing on the lower surface of the second folded sheet 200 and the intermediate sheet portion 204 overlying it.

It should be noted that although the total number of the first and second sheets 10, 20 is five in FIGS. 1 to 3 so that the band of interconnected sheets of FIG. 3 is divided into six regions, the total number of the first and second sheets 10, 20 is ordinarily from 30 to 100 in an actual sheet package. However, the total number of the first and second sheets 10, 20 should not be limited to such range.

The sheet stack 1 shown in FIG. 4 is accommodated in a container 30 shown in FIG. 6. For example, the container 30 is formed from a soft packaging material into a pillow type packaging form. The packaging material comprises a material which can keep the container 30 air-tight so that a liquid impregnated into the first and second sheets 10, 20 will not evaporate. Preferably, the packaging material is composed of a laminate of a resin film of polyethylene terephthalate, polypropylene or the like and a metal foil such as aluminum foil, and a polyethylene film layer provided on the interior surface of the laminate as a sealant layer. In the pillow type packaging process, after wrapping the sheet stack 1 in the packaging material, the packaging material is heat-sealed to itself through the sealant layer to have a longitudinal seal and widthwise seals, thereby providing the container 30 which can accommodate the sheet stack 1 air-tightly.

The container 30 is provided with a dispensing opening 31, which is formed by cutting out a portion of the packaging material. On the exterior surface of the container 30, a soft lid (cover) 32 for covering the dispensing opening 31 is adhered through a repeatedly peelable pressure-sensitive adhesive layer. This lid 32 is also formed from a material which can keep air-tightness so that a liquid impregnated into the first and second sheets 10, 20 accommodated in the container 30 will not evaporate. For example, the lid 32 is formed from a laminated sheet mainly composed of a polyethylene film.

In an alternative, the container 30 may be a hard container formed from plastic, cardboard or the like. In this case, a lid likewise formed from plastic, cardboard or the like is provided for opening and closing the dispensing opening 31.

The first sheets 10 and the second sheets 20 forming the sheet stack 1 accommodated in the container 30 is impregnated with a liquid. For example, the liquid contains 6% by weight of propylene glycol, 0.2% by weight of methylparaben, 0.1% by weight of ethylparaben, the balance being ion-exchanged water, and is added in an amount of 200 to 300% by weight of the sheet stack 1.

In case where the first and second sheets 10, 20 are impregnated with a liquid, the liquid is present between the outermost sheet portion 103 appearing on the lower surface of the first folded sheet 100 and the outermost sheet portion 201 appearing on the upper surface of the second folded sheet 200. Therefore, the outermost sheet portion 103 and the outermost sheet portion 201 are separably adhered due to surface tension of the liquid membrane or capillary action of the liquid between the confronting surfaces. Similarly, the outermost sheet portion 203 appearing on the lower surface of the second folded sheet 200 and the outermost sheet portion 101 appearing on the upper surface of the first folded sheet 100 underlying it are adhered through the liquid.

As shown in FIG. 6, in a sheet package 2 in which the sheet stack 1 is accommodated in the container 30, the outermost sheet portion 101 of the first folded sheet 100 at the highest position of the sheet stack 1 confronts the dispensing opening 31 from the side of the interior surface of the container 30. If the second folded sheet 200 is at the highest position of the sheet stack 1, on the other hand, its outermost sheet portion 201 confronts the dispensing opening 31 from the side of the interior surface of the container 30.

When the lid 32 is peeled off at the beginning of use of the sheet package 2, since the outermost sheet portion 101 of the first folded sheet 100 at the highest position confronts the dispensing opening 31, the outermost sheet portion 101 can be pinched by inserting fingers through the dispensing opening 31. As the first sheet 10 folded into the first folded sheet 100 is removed by pinching the outermost sheet portion 101, the outermost sheet portion 201 of the second folded sheet 200 is dragged by the first sheet 10 to protrude from the dispensing opening 31, because the outermost sheet portion 201 of the second folded sheet 200 is adhered to the outermost sheet portion 103 appearing on the lower surface of the folded sheet 100 through the liquid.

As the first sheet 10 is removed, moreover, the second folded sheet 200 inside of the container 30 is given resistance from the edge of the dispensing opening 31. With this resistance, the outermost sheet portion 201 of the second folded sheet 200 is separated from the outermost sheet portion 103 of the folded sheet 100 thus removed. As a result, after the first sheet 10 is completely removed from the container 30, the second folded sheet 200 dragged by the first sheet 10 is left on the side of the container 30 with the outermost sheet portion 201 protruding from the dispensing opening 31, as shown in FIG. 7, or with the outermost sheet portion 201 and a portion of the intermediate sheet portion 202 protruding from the dispensing opening 31 in an unfolded state.

For removing a next sheet, the outermost sheet portion 201 protruding from the dispensing opening 31 is pinched and pulled by fingers. Here, the outermost sheet portion 201 is solely pinched and pulled by fingers without overlapping with the intermediate sheet portion 202. Therefore, in the course of removal from the container 30, the second folded sheet 200 is unfolded and developed into the state of the second sheet 20 having a large area. Since the second sheet 20 thus removed is not folded, it can be used for wiping operation as it is, without the need of unfolding and developing it by hands.

As the second sheet 20 folded into the second folded sheet 200 is removed, on the other hand, the outermost sheet portion 101 of the first folded sheet 100 underlying it is dragged so that the outermost sheet portion 101 or the outermost sheet portion 101 and a portion of the intermediate sheet portion 102 protrude from the dispensing opening 31 to wait for next removal. By repeating such operation, each time the sheet closest to the dispensing opening 31 in the sheet stack 1 is removed, the outermost sheet portion of the next folded sheet protrudes from the dispensing opening 31.

Figure 8:
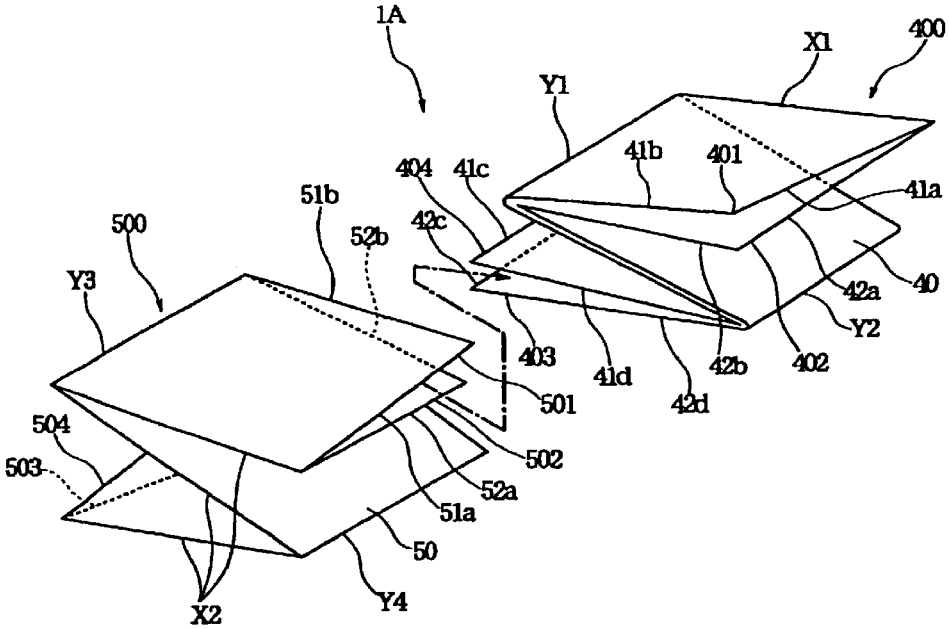
FIG. 8 is a perspective view illustrating how first folded sheets and second folded sheets are combined in a sheet stack according to a second embodiment of the present invention.
Figure 9A:
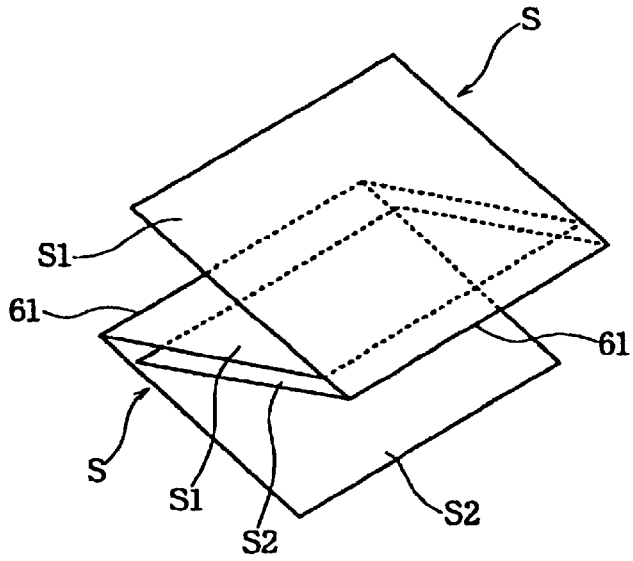
Fig. 9A PRIOR ART
FIGS. 9A, 9B and 9C are perspective views illustrating how sheets are combined in the conventional sheet stacks.
Figure 9B:
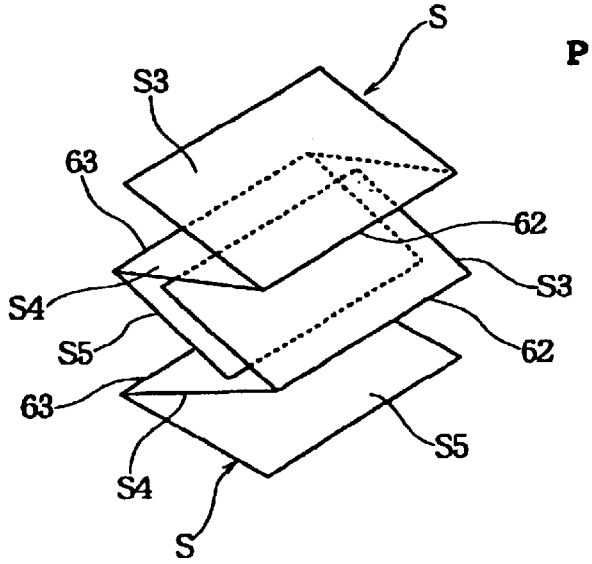
Fig. 9B PRIOR ART
Figure 9C:
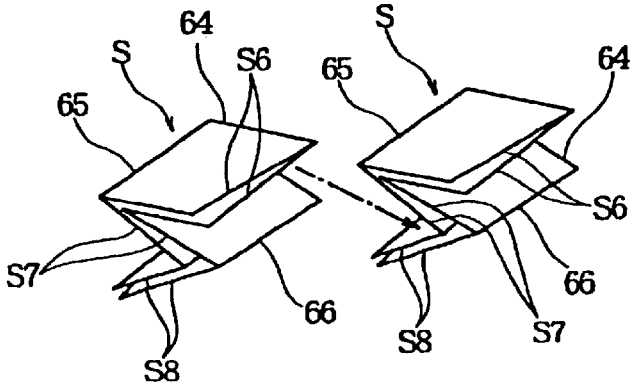
Fig. 9C PRIOR ART

FIG. 8 is a perspective view illustrating combined structure of sheets in a sheet stack 1A according to a second embodiment of the present invention.

In FIG. 8, a rectangular first sheet 40 is folded into a first folded sheet 400, and a rectangular second sheet 50 is likewise folded into a second folded sheet 500. The first sheet 40 and the second sheet 50 are identical in size and thickness. Also, the first sheet 40 and the second sheet 50 are made of the same material. Moreover, the first and second sheets 40, 50 in this second embodiment are identical in size and thickness to and made of the same material as that of the first and second sheets 10, 20 in the foregoing first embodiment.

In the sheet stack 1A shown in FIG. 8, the first folded sheet 400 is formed such that the first sheet 40 is first folded on one X-axis folding line X1 in two, and then folded on two Y-axis folding lines Y1 and Y2 in a Z configuration, as viewed from side. As a result, an outermost sheet portion 401, which is defined by a portion of the X-axis folding line X1, the Y-axis folding lines Y1 and two free edges 41*a* and 41*b*, appears on the upper surface of the folded sheet 400. On the other hand, another outermost sheet portion 403, which is defined by a portion of the X-axis folding line X1, the Y-axis folding lines Y2 and free edges 42*c* and 42*d*, appears on the lower surface of the folded sheet 400.

Inside of the outermost sheet portion 401 appearing on the upper surface of the first folded sheet 400, an intermediate sheet portion 402 is located. This intermediate sheet portion 402 is a rectangular sheet portion defined by a portion of the X-axis folding line X1, the Y-axis folding line Y1, and free edges 42*a* and 42*b*. Inside of the outermost sheet portion 403 appearing on the lower surface of the first folded sheet 400, on the other hand, an intermediate sheet portion 404 is located. This intermediate sheet portion 404 is a rectangular sheet portion defined by a portion of the X-axis folding line X1, the Y-axis folding line Y2, and free edges 41*c* and 41*d*.

The second folded sheet 500 is formed such that the second sheet 50 is first folded on one X-axis folding line X2 in two, and then folded on two Y-axis folding lines Y3 and Y4 in a Z configuration, as viewed from side. As a result, a rectangular outermost sheet portion 501, which is defined by a portion of the X-axis folding line X2, the Y-axis folding lines Y3 and free edges 51*a* and 51*b*, appears on the upper surface of the folded sheet 500. Inside of the outermost sheet portion 501, an intermediate sheet portion 502, which is defined by a portion of the X-axis folding line X2, the Y-axis folding line Y3 and free edges 52*a* and 52*b*, is located.

On the other hand, another rectangular outermost sheet portion 503, which is defined by a portion of the X-axis folding line X2, the Y-axis folding lines Y4 and free edges, appears on the lower surface of the second folded sheet 500. Inside of the outermost sheet portion 503, an intermediate sheet portion 504 is also located.

The first folded sheet 400 and the second folded sheet 500 are combined such that the X-axis folding lines X1 and X2 are positioned at opposite sides, and the Y-axis folding lines Y2 and Y3 are also positioned at opposite sides. At this time, the outermost sheet portion 403 appearing on the lower surface of the first folded sheet 400 is sandwiched between the outermost sheet portion 501 appearing on the upper surface of the second folded sheet 500 and the intermediate sheet portion 502 underlying it. That is, the outermost sheet portion 501 appearing on the upper surface of the second folded sheet 500 is sandwiched between the outermost sheet portion 403 appearing on the lower surface of the first folded sheet 400 and the intermediate sheet portion 404 overlying it.

Likewise, when another first folded sheet 400 is located below the second folded sheet 500 of FIG. 8, the outermost sheet portion 401 appearing on the upper surface of the first folded sheet 400 is sandwiched between the outermost sheet portion 503 appearing on the lower surface of the second folded sheet 500 and the intermediate sheet portion 504 overlying it.

The combination of the first and second folded sheets 400 and 500 thus illustrated in FIG. 8 can be performed using a process similar to that shown in FIGS. 1 to 3.

In this case, when the first and second sheets 40 and 50 are arranged, the spacing between adjacent first sheets 40 in the X-axis direction and the spacing between adjacent second sheets 50 in the X-axis direction are increased, as compared with those in FIG. 1, so that the length of the overlapping region between the first and second sheets 40 and 50 in the X-axis direction (La in FIG. 1) is set equal to or less than ⅓ the length of the sheets 40 and 50 in the X-axis direction (Lx in FIG. 1). Accordingly, the area of the overlapping region between the sheets 40 and 50 (La×Lb in FIG. 1) is equal to or less than ⅙ the area of the sheets 40 and 50 in the developed state.

Then, the first sheets 40 are folded as in FIG. 2, and thereafter, the second sheets 50 are folded as in FIG. 3. After the sheets 40 and 50 are thus interconnected into a band, the individual first sheets 40 are folded to have the two Y-axis folding lines Y1 and Y2 in a region other than the overlapping region between the sheets 40 and 50, and the individual second sheets 50 are folded to have the two Y-axis folding lines Y3 and Y4 in a region other than the overlapping region between the sheets 40 and 50, thereby forming the sheet stack 1A in which the first folded sheets 400 and the second folded sheets 500 are combined as in the manner shown in FIG. 8.

In this embodiment, too, when the first sheet 40 is removed through the dispensing opening 31 of the container 30, the outermost sheet portion 501 of the next second folded sheet 500 protrudes from the dispensing opening 31. Then, the second sheet 50 can be unfolded and removed from the container 30 by pulling the outermost sheet portion 501 thus protruding.

It should be noted that the present invention is not limited to the first and second embodiments set forth above. The first and second folded sheets may be folded in any suitable manner as long as outermost sheet portions defined by an X-axis folding line, a Y-axis folding line and two free edges appear on two external surfaces of the individual folded sheet.

For example, in formation of the first folded sheets and the second folded sheets, the individual first and second sheets may be folded on two X-axis folding lines in a Z configuration, and then folded on one or two Y-axis folding lines. In this case, too, it is possible to combine the first and second folded sheets as in the first and second embodiments.

As has been described above, in the first embodiment shown in FIGS. 4 and 5, the area of the top surface of the sheet stack 1 can be set equal to or slightly larger than ¼ the area of 1 the sheets 10 and 20 in the developed state. In the second embodiment shown in FIG. 8, on the other hand, the area of the top surface of the sheet stack 1A can be set equal to or slightly larger than ⅙ the area of the sheets 40 and 50 in the developed state. Thus, the resulting sheet package in which the sheet stack 1 or 1A is accommodated in the container 30 can be made compact.

In addition, in the course of removal, the individual sheets are unfolded to have a large area. Therefore, they can be used for wiping operation as it is.

It should be noted that the present invention is not limited to the wet sheets, but is also applicable to the type in which sheets to be accommodated in a dry condition are combined in pop-up manner.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A sheet package comprising: a sheet stack formed by folding and stacking a plurality of rectangular sheets; and a container accommodating the sheet stack, the container having a dispensing opening through which the sheets are to be removed, each sheet being first folded on at least one X-axis folding line substantially parallel to one side of the rectangular shape, and then folded on at least one Y-axis folding line substantially perpendicular to the X-axis folding line, thereby to form a folded sheet having two outermost sheet portions appearing on two external surfaces thereof and intermediate sheet portions positioned between the outermost sheet portions, adjacent folded sheets being combined such that X-axis folding lines of the adjacent folded sheets are positioned at opposite sides of the sheet stack and only an outermost sheet portion of one folded sheet is sandwiched between an outermost sheet portion and an intermediate sheet portion of the other folded sheet.

2. A sheet package as set forth in claim 1, wherein each sheet is first folded on a single X-axis folding line and then folded on two Y-axis folding lines.

3. A sheet package as set forth in claim 1, wherein the sheets are impregnated with a liquid so that between the adjacent folded sheets, the outermost sheet portions are separably adhered to each other through the liquid.

4. A sheet package as set forth in claim 1, wherein when a sheet is removed through the dispensing opening, an outermost sheet portion of another sheet adjacent to the sheet being removed is dragged to protrude from the dispensing opening.

* * * * *